US010087930B2

(12) United States Patent
Ott et al.

(10) Patent No.: US 10,087,930 B2
(45) Date of Patent: Oct. 2, 2018

(54) VANE FOR A VANE CELL PUMP AND VANE CELL PUMP

(71) Applicant: Joma-Polytec GmbH, Bodelshausen (DE)

(72) Inventors: Hans-Peter Ott, Hirrlingen (DE); Bernd Hess, Nuertingen (DE); Stefanie Wuhrer, Burladingen (DE); Martin Thoma, Riederich (DE); Torsten Helle, Dusslingen (DE); Friedhelm Pfitzer, Rangendingen (DE)

(73) Assignee: Joma-Polytec GmbH, Bodelshausen (DE)

( * ) Notice: Subject to any disclaimer, the term of this patent is extended or adjusted under 35 U.S.C. 154(b) by 45 days.

(21) Appl. No.: 15/206,977

(22) Filed: Jul. 11, 2016

(65) Prior Publication Data

US 2017/0016443 A1 Jan. 19, 2017

(30) Foreign Application Priority Data

Jul. 13, 2015 (DE) ..... 10 2015 213 098

(51) Int. Cl.
*F01C 1/00* (2006.01)
*F03C 2/00* (2006.01)
(Continued)

(52) U.S. Cl.
CPC ..... *F04C 2/348* (2013.01); *F01C 21/0881* (2013.01); *F04C 18/348* (2013.01);
(Continued)

(58) Field of Classification Search
CPC ..... F04C 2/344; F04C 2/348; F04C 2/3446; F04C 18/344; F04C 18/348; F04C 25/02; F04C 2240/20; F01C 21/0881
(Continued)

(56) References Cited

U.S. PATENT DOCUMENTS 4,124,676 A 11/1978 Henzl
4,604,041 A * 8/1986 Hertell ..... F01C 21/0863 418/268
(Continued)

FOREIGN PATENT DOCUMENTS

CN 1404555 A 3/2003
DE 3712354 A1 5/1988
(Continued)

OTHER PUBLICATIONS

Office action for German application No. 10 2015 213 098.3 dated Jun. 17, 2016.
(Continued)

*Primary Examiner* — Theresa Trieu
(74) *Attorney, Agent, or Firm* — Pearne & Gordon LLP

(57) ABSTRACT

A vane for a vane cell vacuum pump. The vane can be rotated about an axis of rotation by a rotor in a pump chamber and guided in the longitudinal direction in the rotor, with an upper side and a lower side to abut against the bottom and the ceiling of the pump chamber, with a rear side opposite a front side to limit the pressure chambers, with at least one face to slidably abut against an inside wall of the pump chamber on the casing side. The vane comprises a base body of a first plastic material and a vane end molded of a second plastic material to the base body forming the face. The base body comprises a mounting section around which the vane end is formed. The mounting section comprises at least one recess transverse to the front side and/or the rear side.

14 Claims, 3 Drawing Sheets

(51) Int. Cl.

| | |
|---|---|
| ***F03C 4/00*** | (2006.01) |
| ***F04C 2/348*** | (2006.01) |
| ***F01C 21/08*** | (2006.01) |
| ***F04C 25/02*** | (2006.01) |
| ***F04C 18/344*** | (2006.01) |
| ***F04C 18/348*** | (2006.01) |

(52) U.S. Cl.
CPC ..... *F04C 18/3446* (2013.01); *F04C 25/02* (2013.01); *F04C 2240/20* (2013.01)

(58) Field of Classification Search
USPC ..... 418/229, 152, 253–255
See application file for complete search history.

(56) References Cited

U.S. PATENT DOCUMENTS

| | | | | |
|---|---|---|---|---|
| 4,846,642 | A | 7/1989 | Nuber et al. | |
| 6,655,937 | B2 * | 12/2003 | Hasert | F01C 21/0809 418/152 |
| 7,588,433 | B2 * | 9/2009 | Kishi | F04C 18/344 418/255 |

FOREIGN PATENT DOCUMENTS

| | | | |
|---|---|---|---|
| DE | 10307040 | A1 | 9/2004 |
| DE | 102004034921 | B3 | 12/2005 |
| DE | 102005056270 | B3 | 3/2007 |
| DE | 102005050001 | A1 | 4/2007 |
| DE | 102010026034 | A1 | 1/2012 |
| DE | 1022011108942 | A1 | 1/2013 |
| EP | 1322864 | A1 | 7/2003 |
| WO | 0225113 | A1 | 3/2002 |
| WO | 2004074687 | A2 | 9/2004 |
| WO | 2006005381 | A1 | 1/2006 |
| WO | 2007042135 | A1 | 4/2007 |
| WO | 2015044099 | A1 | 4/2015 |

OTHER PUBLICATIONS

European Search Report for EP 16173478 dated Dec. 9, 2016.
Office Action for Chinese Application No. 201610547863.X dated Jul. 4, 2018.

* cited by examiner

VANE FOR A VANE CELL PUMP AND VANE CELL PUMP

CROSS-REFERENCE TO RELATED APPLICATION

This application claims the benefit of German Patent Application No. 10 2015 213 098.3 filed Jul. 13, 2015, the entire disclosure of which is incorporated herein by reference.

BACKGROUND

The invention relates to a vane for a vane cell pump—in particular, for a vacuum pump—as well as a vane cell pump—in particular, a vacuum pump.

A vane cell pump with generic vanes is known, for example, from WO 02/25113 A1. The vanes shown there comprise an upper side and a lower side to abut against the bottom and against the ceiling of a pump chamber, wherein the vanes also provide a front side and a rear side opposite the front side to limit the pressure chambers formed in the pump chamber. The vane also provides two faces to slidably abut against an inside wall of the pump chamber on the casing side, wherein the vane comprises a base body made of a first plastic material and a vane end that is molded to the base body, forms the face of the vane, and consists of a second plastic material. The base body is preferably made of a thermosetting plastic that is comparatively inexpensive, wherein the vane end preferably consists of a thermoplastic that has favorable wear and tear and friction properties. The base body comprises a mounting section around which the vane end is formed and which comprises grooves running parallel to the face of the vane. These grooves are filled, in particular, by the material of the second plastic during the molding of the vane end.

Starting with such a vane, as previously known from WO 02/25113 A1, the present task of the invention consists in creating a vane and a corresponding vane cell pump that, in particular, also operates reliably at higher temperatures and with which higher pump performances can also preferably be provided.

BRIEF SUMMARY

This aim is achieved by a vane having the features of claim 1. In particular, such a vane provides that the mounting section comprises at least one recess that runs in a direction transverse to the front and/or rear side. The provision of such a recess in the mounting section has the advantage that the front side can be molded securely to the base body, so that the pump can be safely operated even at higher temperatures and/or when the pump's dimensions are larger, and, in particular, when the vanes are built higher. For the known vanes, it has, in particular, been discovered that at higher operating temperatures, the vane ends are no longer securely fixed to the base body due to the different coefficients of expansion of the different plastics, but conditionally move, in particular, in the direction orthogonal to the upper or lower side with respect to the base body. By providing at least one recess—and, preferably, several recesses—which are provided in a transverse direction on the mounting section and in which the second plastic material of the vane end engages when the vane end is molded, an improved arrangement of the vane ends on the mounting section is achieved. A vane cell pump equipped with such a vane can be used at higher operating temperatures. Moreover, the vane may also be built higher in the direction orthogonal to the upper or lower side, without compromising the secure mounting of the vane ends on the base body. Overall, an increase in the performance of the vane cell pump can thereby be provided.

The at least one recess preferably comprises holding surfaces running parallel to the upper and/or lower side. In particular, forces acting orthogonally to the upper and/or lower side on the vane end can be diverted into these holding surfaces in the base body. A movement or separation of the vane end in the direction orthogonal to the upper and/or lower side of the vane is thereby prevented.

The vane may preferably provide vane ends made of the second plastic material on both faces; such a vane is then used in a vane cell pump with one vane.

The slidable abutment of the faces on the inside wall of the pump chamber on the casing side may be direct, or a sliding agent, such as an oil film, may be provided between the faces and the inside wall.

Advantageously, when viewing the upper or lower side of the one face from above, the contour of the one vane end is axially symmetrical to the contour of the other vane end, wherein the axis of symmetry is then, in particular, the axis of rotation or the center vertical axis of the vane.

The at least one recess is preferably provided vertically in the middle region of the mounting section. This results in an even fixation of the vane end to the base body.

As an alternative or in addition, at least one recess is preferably provided in the region of the upper side and/or lower side of the mounting section. Such a recess also contributes to the firm fixation of the vane end to the base body.

The one or several recesses may be designed such that they completely extend through the mounting section in the transverse direction. However, it is also conceivable that the recesses are designed as "dead end" recesses and provide a bottom when viewed in the transverse direction that is, in particular, formed by the mounting section.

It is particularly advantageous if the at least one recess comprises undercuts when viewed in the longitudinal direction, i.e., when viewed in the direction orthogonal to the face of the vane. As a result of such undercuts, it is prevented that the respective vane end can be lifted off the base body in the longitudinal direction during operation. Overall, an additional, better fixation of the vane end to the base body is provided.

In doing so, it is advantageous if the at least one recess is designed in the shape of a T when viewed from the transverse direction and, in particular, if the cross-bars of the T form the undercuts. Such recesses can be realized easily, and nonetheless result in a secure fixation of the vane ends.

It is, in particular, conceivable that, on the mounting section, several and/or differently designed recesses are provided that are adapted to the respective requirements of the vane end or the vane.

Furthermore, it is advantageous if the mounting section comprises one groove each on the front side and the rear side of the mounting section when viewed in the transverse direction, wherein the two grooves are provided such that they run laterally offset with respect to each other. In contrast, two longitudinal grooves, which lie in the same transversal plane as the vane, are provided according to WO 02/25113 A1 from the prior art. Due to the offset arrangement of the grooves, a better fixation of the vane end to the base body can be achieved.

In doing so, it is conceivable that the groove bars limiting the two grooves and facing away from the base body are connected by a wall section that runs diagonally to the front side and/or rear side when viewing the upper side and/or bottom side from above. By providing such a diagonally running wall section, a better transmission of the forces that act on the vane ends to the base body can be provided. This also results in a better fixation of the vane ends to the base body.

The vane ends per se can preferably be designed to run asymmetrically to the center longitudinal plane of the vane when viewed from above. This results in a more optimal adaptation of the vane end to the casing-shaped inside wall of the pump chamber, as well as a favorable distribution of the forces acting on the vane ends.

When viewed from above, the vane end may comprise a first bellied section and a flat second section running diagonally to the front and/or rear side of the vane, wherein the second section is preferably facing the low pressure chamber during operation of the vane cell pump. It has been shown that precisely such a contour of the vane contributes to good pump properties.

Furthermore, it is advantageous if the second section is adjoined by at least one additional flat third section also running diagonally to the front and/or rear side, wherein the third section encloses a smaller angle with the front side and/or the rear side than the second section or runs parallel to the second section. It has been shown that such a contour results in additional positive properties of the pump.

The aim upon which the invention is based is also achieved by a vane cell pump—in particular, a vacuum pump—that provides a pump chamber, a rotor mounted rotatably in the pump chamber, and a vane according to the invention that is mounted guidably in the radial direction in the rotor.

Additional advantages and individual embodiments of the invention are to be taken from the description below, by reference to which an exemplary embodiment of the invention is described and explained in more detail.

DETAILED DESCRIPTION

Figure 1:
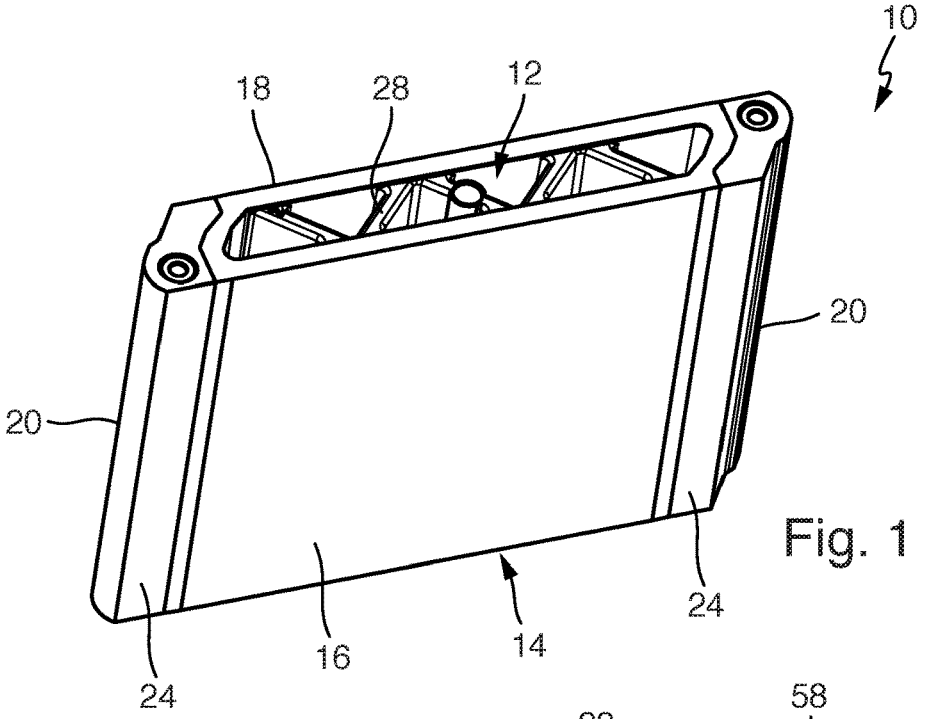
FIG. 1 is a perspectival view of a vane according to the invention.
Figure 2:
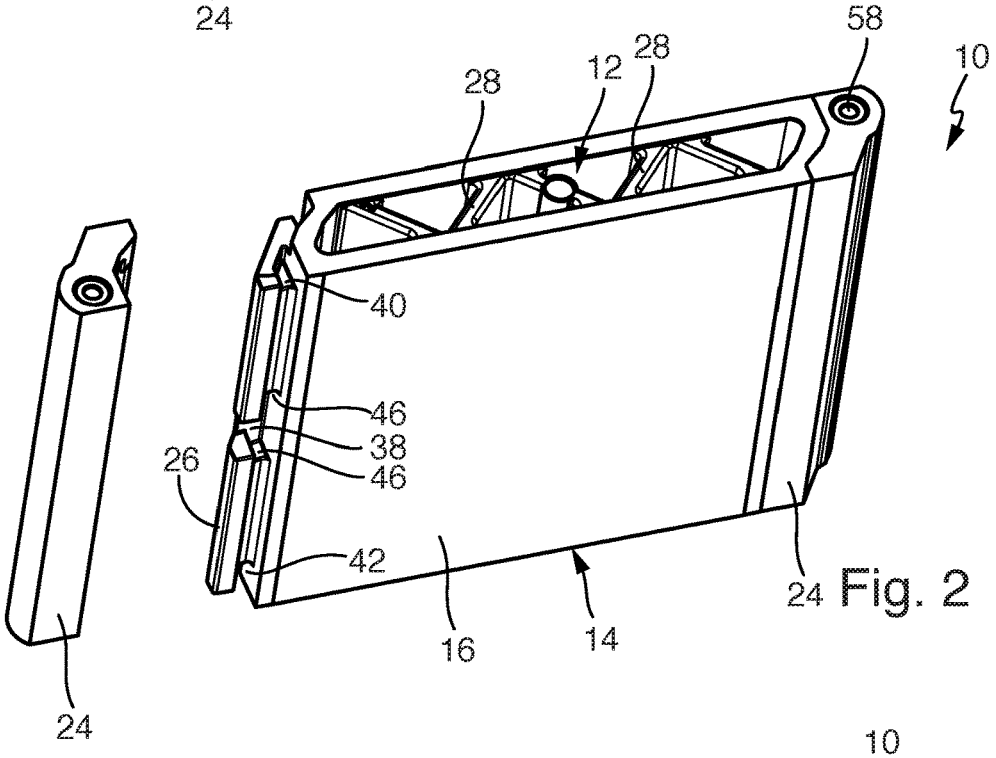
FIG. 2 is a top view of the vane according to FIG. 1.
Figure 3:
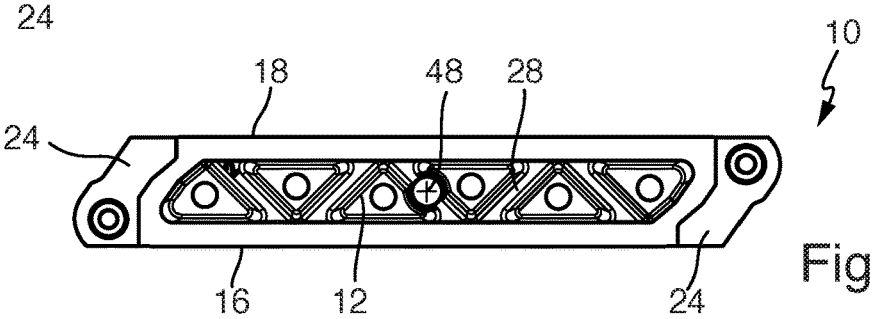
FIG. 3 is the view of the vane according to FIG. 1, with a separately illustrated vane end.
Figure 9:
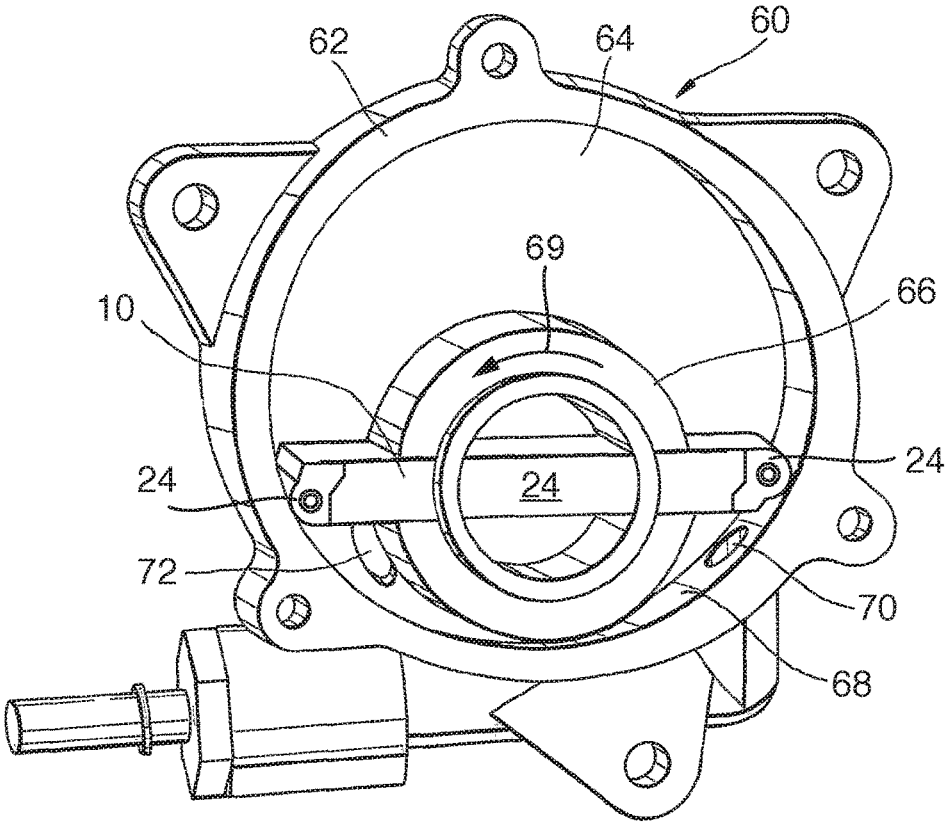
FIG. 9 is a vane cell pump according to the invention with a vane according to FIG. 1.

FIGS. 1 through 3 show a vane 10 according to the invention for a vane cell pump as shown in FIG. 9, for example. The vane 10 has an upper side 12 and a lower side 14. Furthermore, running orthogonally thereto, it comprises a front side 16 and a rear side 18. At its free ends 24, the vane 10 provides two faces 20. The vane 10 comprises a base body 22, which is made of a first plastic material that is comparatively inexpensive, break-proof, and dimensionally stable, such as PPS with glass fibers. On the base body 22, the vane ends 24 forming the faces 20 are provided, which are made of a wear-resistant material, such as PEK or irradiated PA66. The vane ends 24 are molded to the mounting section 26, which can be seen especially well in FIGS. 4 through 7.

The base body 22 comprises a closed front side 16 and a closed rear side 18, as shown clearly in FIGS. 1, 2, and 3, wherein the base body as a whole is designed in the manner of a lattice, with bars 28 running diagonally to the front side 16 and the rear side 18.

The vane ends 24 are preferably molded to the base body 22 in a two-component injection molding process.

As can be seen clearly in FIGS. 4 through 7, which show only the base body 22 without the vane ends 24, the mounting sections 26 provide in the region of their front side and rear side, respectively, a groove 30, 32 running parallel to the face 20. The grooves do not lie in a common plane running orthogonal to the front or rear side 16, 18, but are arranged laterally offset with respect to one another.

Figure 6:
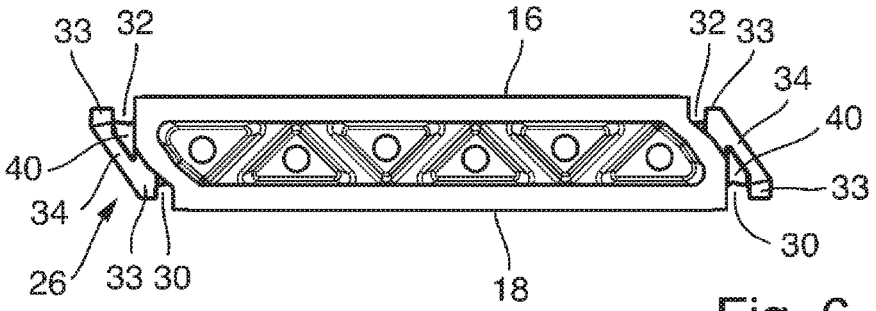
FIG. 6 is a top view of the base body according to FIG. 4.
Figure 7:
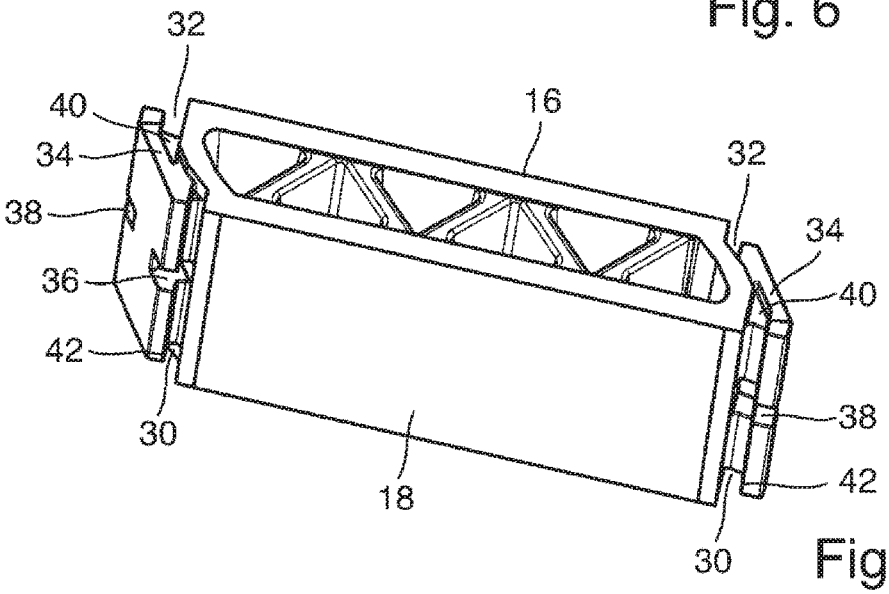
FIG. 7 is the base body according to FIG. 4 in a perspectival view, diagonally from above.

As the top view according to FIG. 6 in particular shows, the two groove bars 33, which limit the two grooves 30, 32, are connected to one another via a wall section 34, which, in the top view, runs diagonally to the front side 16 and the rear side 18.

As is also shown in the FIGS. 4 through 7, the two mounting sections 26, respectively, comprise four recesses 36, 38, 40, 42, which extend in a direction transverse to the front side 16 and the rear side 18.

The recesses 36 and 38, respectively, are provided in the center region of the mounting section 26 and comprise, respectively, two holding surfaces 43 running parallel to the upper and/or lower side 12, 14 and a bottom 45. The recess 38 is thereby introduced by the front side 16 of the base body 22; the recess 40, by the rear side 18 of the base body 22.

Figure 5:
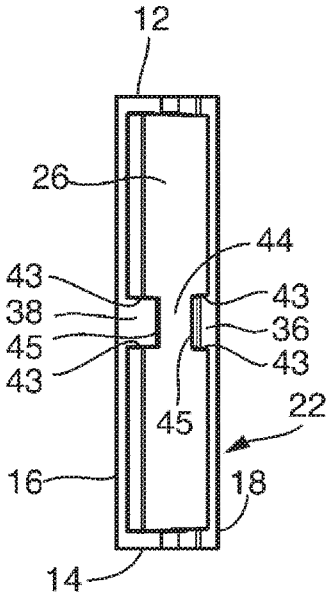
FIG. 5 is a lateral view of the base body according to FIG. 4.

As can be seen clearly in FIG. 5, there is a bar 44 between the recesses 36 and 38; the recesses 36 and 38 thus do not completely extend through the mounting section 26 in the transverse direction. It is conceivable that recesses that extend completely through the mounting section in the transverse direction are also provided.

Figure 4:
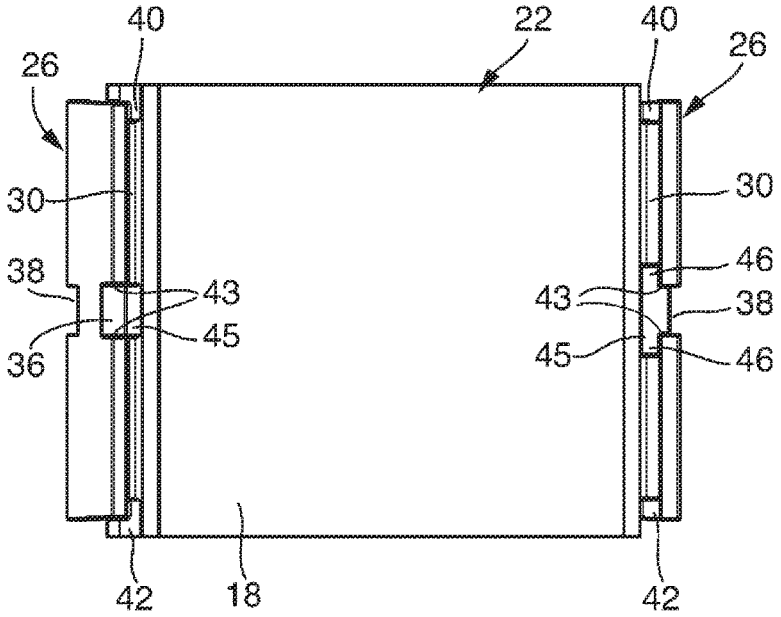
FIG. 4 is a frontal view of the base body of the vane according to FIG. 1.

As can be seen clearly in FIG. 2 or 4, for example, the recesses 38 comprise undercuts 46 when viewed in the longitudinal direction of the vane 10, i.e., orthogonal to the face 20. The recesses 38 are designed in the shape of a T, wherein the undercuts 46 are formed by the free ends of the cross-bar of the T. When injection-molding the vane ends 24, these undercuts 46 are filled with the material of the vane ends 24. In this way, a secure fixation of the vane ends 24 to the base body 22 is achieved. At higher temperatures in particular, forces that act orthogonally to the upper and/or lower side can be diverted into the holding surfaces 43 and into the undercuts 46. A movement or separation of the vane end 24 in the direction orthogonal to the upper and/or lower side of the vane ends 24 from the base body 22 can, therefore, not occur.

In vanes 10 that are built higher, i.e., in vanes in which the upper side 12 is spaced further from the lower side 14, it is conceivable to provide additional recesses corresponding to the recesses 38 and 40 in the mounting section 26.

Figure 8:
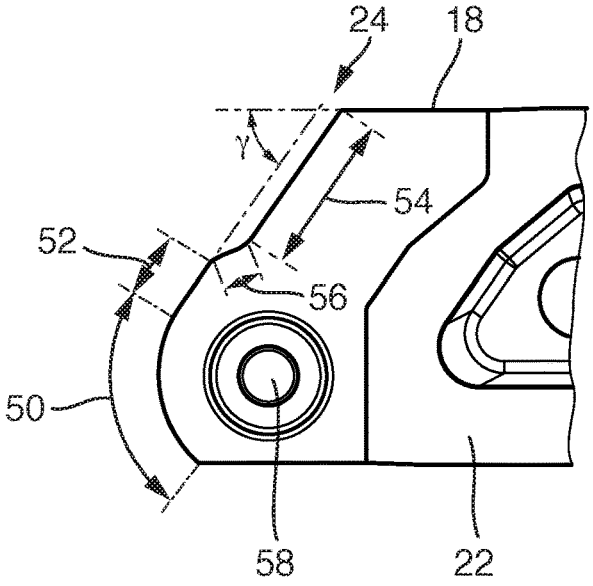
FIG. 8 is an enlarged view of the vane end of FIG. 3.

As can be clearly seen in particular in the top view according to FIG. 3, the vane ends 24 are designed to be asymmetrical, wherein the center vertical axis 48 is axially symmetrical. In the section of FIG. 3 enlarged in FIG. 8, which shows a vane end 24, it can clearly be seen that the vane ends 24 comprise a bellied section 50 that is provided to slidably abut the inside wall 68 of the pump chamber 64 during operation of the pump 60. The bellied section 50 is adjoined by a flat second section 52 running diagonally to the front side 16 and the rear side 18. The section 52 encloses an angle α with the rear side 18 of the vane 10 in the range of 30° to 60° and, in particular, in the range of 55°. During operation, the section 52 faces the low pressure chamber.

This second section 52 is adjoined by a third section 54 that runs parallel to the second section 52, is set back, and is connected via an intermediate section 56 to the section 52. It is also conceivable that the third section 54 runs parallel to the second section 52 and is, in particular, set back from this second section.

On the upper side and the lower side of the end sections, molding points 58 can be seen.

FIG. 9 shows a vacuum pump 60 without a cover, which comprises a housing 62, which surrounds a pump chamber 64. In the housing 62, a rotor 66 is rotatably mounted, in which the vane 10 shown in FIGS. 1 through 7 is mounted movably in the longitudinal direction of the vane 10 in a vane slot. During operation of the pump, the vane ends 24 slidably abut an inside wall 68 of the pump chamber 64 on the casing side. In this way, the vane 10 divides the pump chamber 64 into different pressure chambers. During operation, the rotor 66 rotates about its axis of rotation along the arrow 69, whereby air, or another fluid such as oil, is sucked in through an inlet opening 70 provided in the housing 62, and air or another fluid is discharged through an additional outlet opening 72.

The vane cell pump shown in FIG. 9 with a vane 10 as shown in FIGS. 1 through 8 has the advantage that the vane ends 24 are securely fixed to the base body 22 at higher temperatures. Due to different temperature coefficients of the material of the base body and of the material of the vane ends 24, it can nonetheless be prevented that the vane ends 24 separate from or slide along the base body 22 at high temperatures or in vanes built high in the vertical direction.

The invention claimed is:

1. A vane for a vane cell pump wherein the vane rotates about an axis of rotation during operation by a rotor in a pump chamber and is guided in a direction orthogonal to a face of the vane in the rotor, with an upper side and a lower side to abut against a bottom and a ceiling of the pump chamber, with a front side and a rear side opposite the front side to limit pressure chambers formed in the pump chamber, wherein the face of the vane slidably abuts against an inside wall of the pump chamber on a casing side, wherein the vane comprises a base body made of a first plastic material and a vane end that is molded to the base body, forms the face, and consists of a second plastic material, and wherein the base body comprises a mounting section around which the vane end is formed, wherein the mounting section comprises at least one recess that runs in a direction transverse to the front side or the rear side, and wherein the at least one recess comprises undercuts when viewed in the direction orthogonal to the face of the vane.

2. The vane according to claim 1, wherein at least one recess is provided in a middle region of the mounting section.

3. The vane according to claim 1, wherein at least one recess is provided in the region of an upper side or a lower side of the mounting section.

4. The vane according to claim 1, wherein the at least one recess extends completely through the mounting section in the transverse direction.

5. The vane according to claim 1, wherein the at least one recess is T-shaped when viewed from the transverse direction and cross-bars of the T form the undercuts.

6. The vane according to claim 1, wherein several or differently shaped recesses are provided in the mounting section.

7. The vane according to claim 1, wherein the mounting section comprises two grooves that are laterally offset with respect to one another and run parallel to the faces when viewed in the transverse direction.

8. The vane according to claim 7, wherein the groove bars limiting the two grooves and facing away from the base body are connected by a wall section that runs diagonally to the front side or the rear side when viewing the upper side or the bottom side from above.

9. The vane according to claim 1, wherein the at least one vane end is asymmetrical when viewed from above.

10. The vane according to claim 9, wherein the vane end comprises a first bellied section and a flat second section that runs diagonally to the front side or the rear side when viewed from above and faces a low pressure chamber during operation.

11. The vane according to claim 10, wherein the second section is adjoined by at least one additional flat third section that also runs diagonally to the front side or the rear side and that encloses a smaller angle with the front side or the rear side than the second section or runs parallel to the second section.

12. A vane cell pump comprising a pump chamber, a rotor that is rotatably mounted in the pump chamber, and a vane according to claim 1 that is mounted guidably in the radial direction in the rotor.

13. The vane cell pump according to claim 12 wherein the vane cell pump is a vacuum pump.

14. The vane for a vane cell pump according to claim 1 wherein the vane cell pump is a vacuum pump.

* * * * *